US007690503B2

(12) United States Patent
Foster et al.

(10) Patent No.: US 7,690,503 B2
(45) Date of Patent: Apr. 6, 2010

(54) PRODUCT DISPLAY AND CARRYING BAG

(75) Inventors: David Neil Foster, Norfolk, MA (US); Wayne Robert Blatchley, Rumford, RI (US); Vincent Anthony D'Alleva, Needham, MA (US)

(73) Assignee: Cosco Management, Inc., Wilmington, DE (US)

( * ) Notice: Subject to any disclaimer, the term of this patent is extended or adjusted under 35 U.S.C. 154(b) by 17 days.

(21) Appl. No.: 11/849,873

(22) Filed: Sep. 4, 2007

(65) Prior Publication Data

US 2008/0217972 A1 Sep. 11, 2008

Related U.S. Application Data

(60) Provisional application No. 60/893,321, filed on Mar. 6, 2007.

(51) Int. Cl.

| | |
|---|---|
| ***B65D 69/00*** | (2006.01) |
| ***B65D 85/00*** | (2006.01) |
| ***B65D 33/06*** | (2006.01) |
| ***B65D 33/04*** | (2006.01) |
| ***B65D 65/02*** | (2006.01) |

(52) U.S. Cl. ..... 206/223; 206/326; 206/459.5; 150/158; 383/6; 383/106

(58) Field of Classification Search ..... 206/335, 206/576, 320, 459.1, 459.5, 810, 223, 326, 206/314, 497, 216; 224/191, 235, 101, 415, 224/275, 409, 409.5, 910; 383/6, 12, 106, 383/105, 16; 297/250.1, 184.13, 184.14; 150/154, 158, 165; 190/903

See application file for complete search history.

(56) References Cited

U.S. PATENT DOCUMENTS

| | | | | |
|---|---|---|---|---|
| 1,496,462 | A | | 6/1924 | Hunt et al. |
| 1,927,492 | A | | 9/1933 | Halpin |
| 1,951,604 | A | | 3/1934 | Friedlander |
| 2,132,337 | A | | 10/1938 | Whiteman |
| 2,223,532 | A | * | 12/1940 | Sallop ..... 224/275 |
| 2,495,391 | A | | 1/1950 | Smith |
| 2,666,953 | A | | 1/1954 | Andrews |
| 2,669,272 | A | | 2/1954 | Permann |
| 2,751,071 | A | | 1/1956 | Goldband |
| 2,850,220 | A | | 9/1958 | Ehrler et al. |
| 3,316,951 | A | | 5/1967 | Jacobson |
| 3,695,418 | A | | 10/1972 | Gwozdz |
| 4,266,704 | A | | 5/1981 | Swanson |
| 4,463,789 | A | | 8/1984 | Leiserson |

(Continued)

OTHER PUBLICATIONS

International Search Report dated Apr. 10, 2008, International Application No. PCT/US 07/79385.

(Continued)

*Primary Examiner*—Mickey Yu
*Assistant Examiner*—Melissa L Lalli
(74) *Attorney, Agent, or Firm*—Barnes & Thornburg LLP

(57) ABSTRACT

A product display and carrying bag. The bag is sized and configured to receive a juvenile vehicle seat therein, thereby forming a package when the seat is contained in the bag. The bag includes upper and lower chambers and side panels overlying the chambers. The bag further includes lifting means for lifting the packaging by a user.

12 Claims, 4 Drawing Sheets

U.S. PATENT DOCUMENTS

| | | | | |
|---|---|---|---|---|
| 4,693,289 | A * | 9/1987 | Taylor et al. | 150/166 |
| 4,703,519 | A | 10/1987 | Krenzel | |
| 4,795,029 | A | 1/1989 | Campbell et al. | |
| 4,811,437 | A | 3/1989 | Dillner et al. | |
| D301,086 | S | 5/1989 | Hess | |
| 4,867,575 | A | 9/1989 | Wood | |
| 4,917,505 | A | 4/1990 | Bullard et al. | |
| 5,074,616 | A * | 12/1991 | Smith | 297/184.13 |
| 5,143,133 | A | 9/1992 | Speckman | |
| 5,282,502 | A * | 2/1994 | Ballard | 150/167 |
| 5,316,139 | A | 5/1994 | Judd et al. | |
| 5,570,829 | A | 11/1996 | Harrison | |
| 5,730,490 | A | 3/1998 | Mortenson | |
| 5,785,383 | A | 7/1998 | Otero | |
| 5,882,120 | A | 3/1999 | Bell | |
| 5,887,777 | A | 3/1999 | Myles et al. | |
| 5,964,350 | A | 10/1999 | LaMarche et al. | |
| 6,073,796 | A | 6/2000 | Mogil | |
| 6,126,012 | A | 10/2000 | Roegner | |
| 6,189,692 | B1 | 2/2001 | Campbell, Jr. | |
| 6,202,722 | B1 * | 3/2001 | Crocker | 150/154 |
| 6,231,233 | B1 | 5/2001 | Orce | |
| 6,328,158 | B1 | 12/2001 | Bisbal et al. | |
| 6,405,869 | B1 | 6/2002 | Whittemore et al. | |
| 6,547,325 | B2 | 4/2003 | Drost et al. | |
| 6,588,596 | B1 | 7/2003 | Holmes et al. | |
| 6,637,485 | B1 * | 10/2003 | Sartena | 150/118 |
| 6,725,893 | B1 * | 4/2004 | Erickson | 150/154 |
| 6,726,019 | B2 | 4/2004 | Leung | |
| 6,773,062 | B2 | 8/2004 | Illulian | |
| 6,923,574 | B2 | 8/2005 | Siegel | |
| 6,953,277 | B2 | 10/2005 | Karslake et al. | |
| 7,055,720 | B1 | 6/2006 | Pritchard | |
| 7,093,699 | B2 * | 8/2006 | Yu | 190/26 |
| 7,198,083 | B1 * | 4/2007 | Sartena | 150/118 |
| 7,213,878 | B2 * | 5/2007 | Delapaz | 297/219.12 |
| 7,341,011 | B2 * | 3/2008 | Pines et al. | 112/475.08 |
| 2003/0110315 | A1 * | 6/2003 | Upton | 709/328 |
| 2003/0116392 | A1 * | 6/2003 | Oh | 190/102 |
| 2004/0074937 | A1 * | 4/2004 | Thomas | 224/155 |
| 2005/0110315 | A1 * | 5/2005 | Littlehorn et al. | 297/219.12 |
| 2005/0161893 | A2 | 7/2005 | Darling | |
| 2006/0151560 | A1 | 7/2006 | Chen | |

OTHER PUBLICATIONS

Allan Zipper, www.allanzipper.com/index.html, 1954, one page, Dated: Oct. 10, 2006.

Custom Bags, Packaging Bags, Nylon & Mesh Bags—LBU Inc., www.lbuinc.com, two pages, Dated: Oct. 10, 2006.

Guntex Industries, www.guntexind.com/index.html, one page, Dated: Oct. 10, 2006.

Transparent Bag Manufacturer & Supplier Directory, Global Sources, www.alibaba.com/catalog/10840031/PVC Zipper Bags for Blankets.html and www.globalsources.com/manufacturers/transparent-bag.html, four pages, Dated: Oct. 10, 2006 .

* cited by examiner

FIG. 1
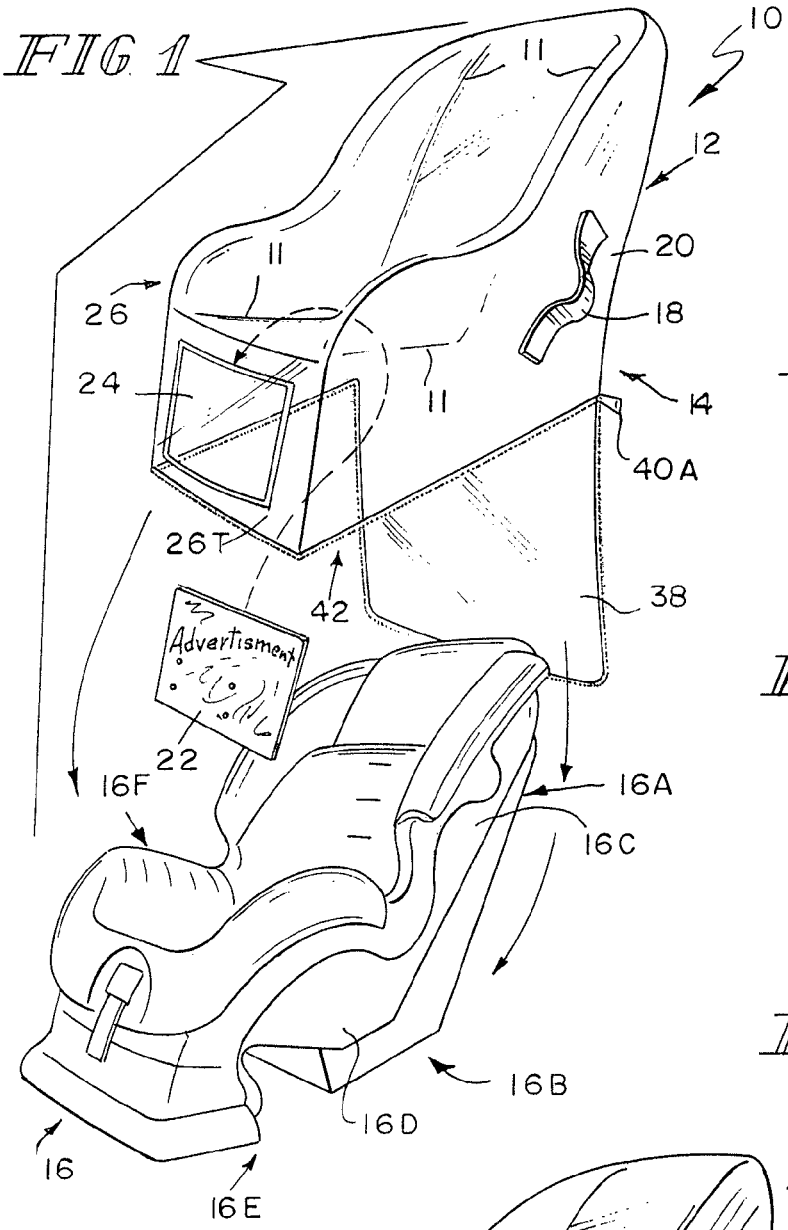
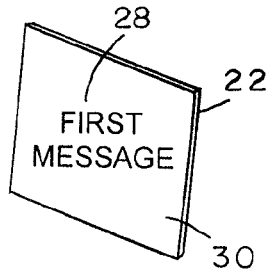
FIG. 2a
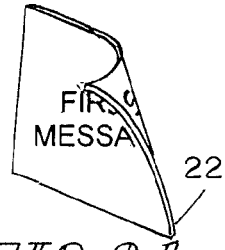
FIG. 2b
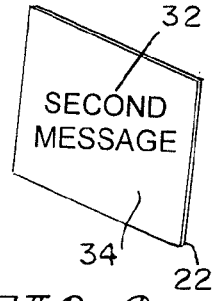
FIG. 2c
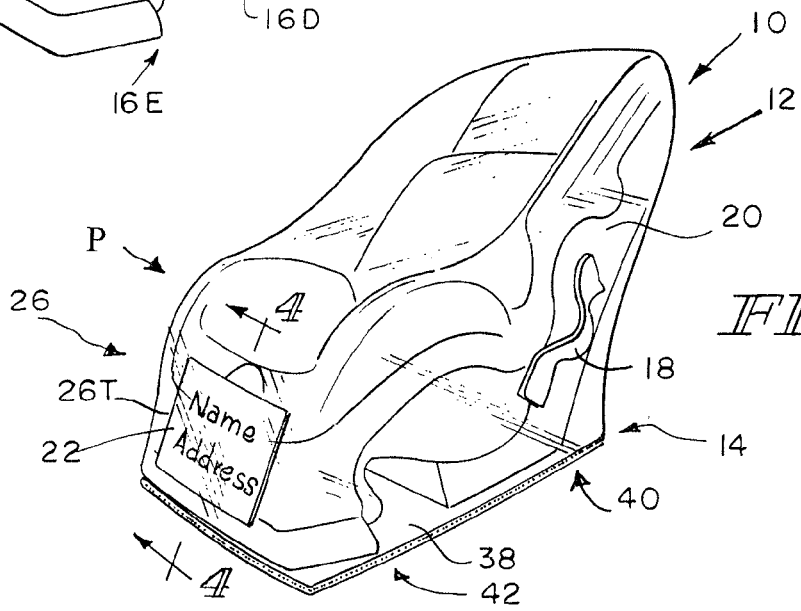
FIG. 3

PRODUCT DISPLAY AND CARRYING BAG

This application claims priority under 35 U.S.C. §119(e) to U.S. Provisional Application Ser. No. 60/893,321, filed Mar. 6, 2007, which is expressly incorporated by reference herein.

BACKGROUND

The present disclosure relates to product display and carrying bags. More particularly, the present disclosure relates to product display and carrying bags for juvenile products.

SUMMARY

In accordance with the present disclosure, a product display and carrying bag is configured to include upper and lower chambers sized to conform to, for example, a juvenile product such as a juvenile vehicle seat. In an illustrative embodiment, the bag includes a carrying handle coupled to a panel of the bag and further includes a media tag configured to be inserted into a card-receiver pocket provided on a transparent panel of the bag.

In an illustrative embodiment, the media tag includes a first message on one side of the media tag and a second message on the other side. The media tag is configured to be "flipped over" and inserted into the card-receiver pocket to reveal either the first or second message.

In an illustrative embodiment, the handle is located on a side panel of the bag in a location such that a user carrying the bag that includes the juvenile seat is able to cradle a notched part of the bag around the user's leg to provide an ergonomically comfortable and space-saving carrying position.

Additional features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the following figures in which:

FIG. 1 is a perspective view of a product display and carrying bag in accordance with the present disclosure, and showing formation of the bag to include upper and lower chambers sized to conform to the configuration of a juvenile vehicle seat and configured to be placed over and contain the seat, and further showing a carrying handle included in the bag and coupled to a side panel of the bag and a media tag configured to be inserted into a card-receiver pocket provided on a transparent front panel of the bag;

FIGS. 2*a*-2*c* are enlarged perspective views of the media tag of FIG. 1 showing the media tag having a first message on one side of the media tag and a second message on the other side, the media tag being configured to be "flipped over" and inserted into the card-receiver pocket on the product display and carrying bag to reveal either the first or second message;

FIG. 3 is a perspective view of the bag of FIG. 1 showing a juvenile vehicle seat contained in the transparent bag and further showing the media tag of FIGS. 2*a*-*c* inserted into the card-receiver pocket provided on the transparent front panel of the tag to reveal one of the messages;

DETAILED DESCRIPTION

Figure 4:
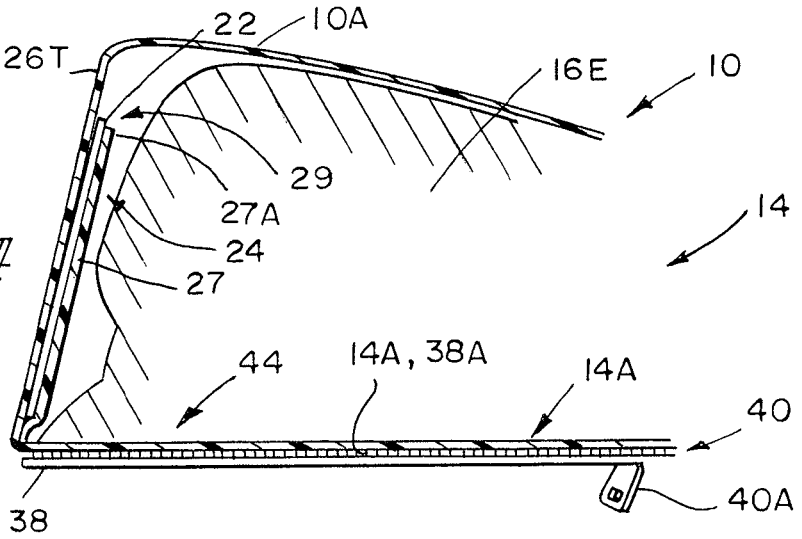
FIG. 4 is a cross-sectional view taken along line 4-4 of FIG. 3 showing the card-receiver pocket on the transparent front panel and the media tag inserted therein and further showing a bottom portion of the seat situated in a lower chamber of the bag and a zipper located in a partly closed position.

In general terms and referring particularly to FIGS. 1-3, the present disclosure relates to a product display and carrying bag 10 having upper and lower chambers 12, 14, respectively. Upper chamber 12 includes a rear area 13 and lower chamber 14 includes a bottom area 15. Upper and lower chambers 12, 14 are sized to conform to the configuration of, for example, a juvenile vehicle seat 16 and configured to be placed over and contain seat 16, as shown in FIG. 3. Together, bag 10 and seat 16 form a package P as shown in FIG. 3 and suggested in FIGS. 6 and 7. Seat 16 includes a back portion 16A, a base portion 16B, upper side portion 16C, lower side portion 16D, bottom portion 16E and front portion 16F.

Figure 6:
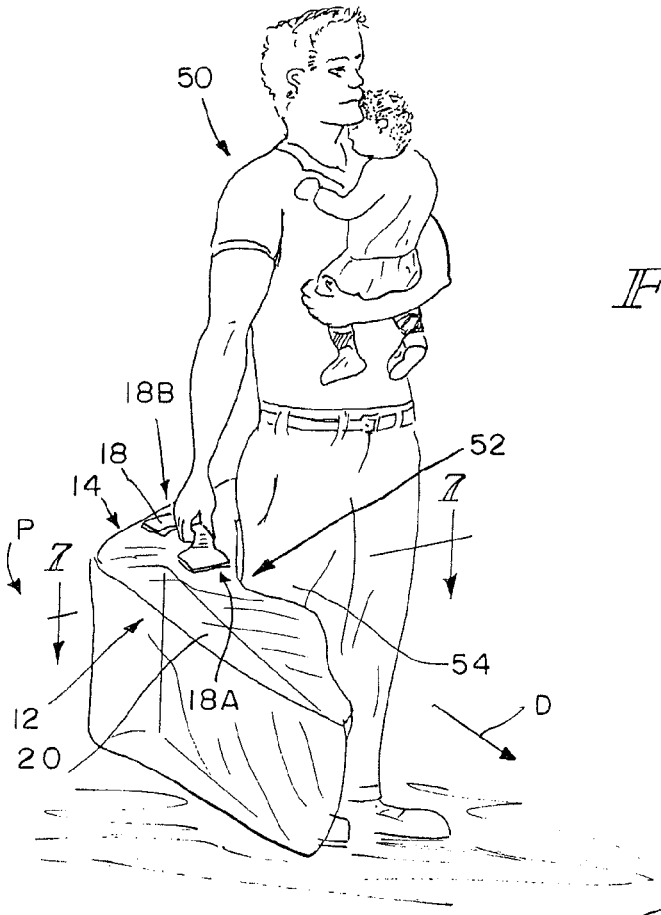
FIG. 6 is a perspective view of a user carrying the bag and showing the handle being located on the side panel in a location such that the user is able to cradle a notched part of the bag around the user's leg to provide an ergonomically comfortable and space-saving carrying position to minimize a part of the bag that extends beyond the side of the user's leg.
Figure 7:
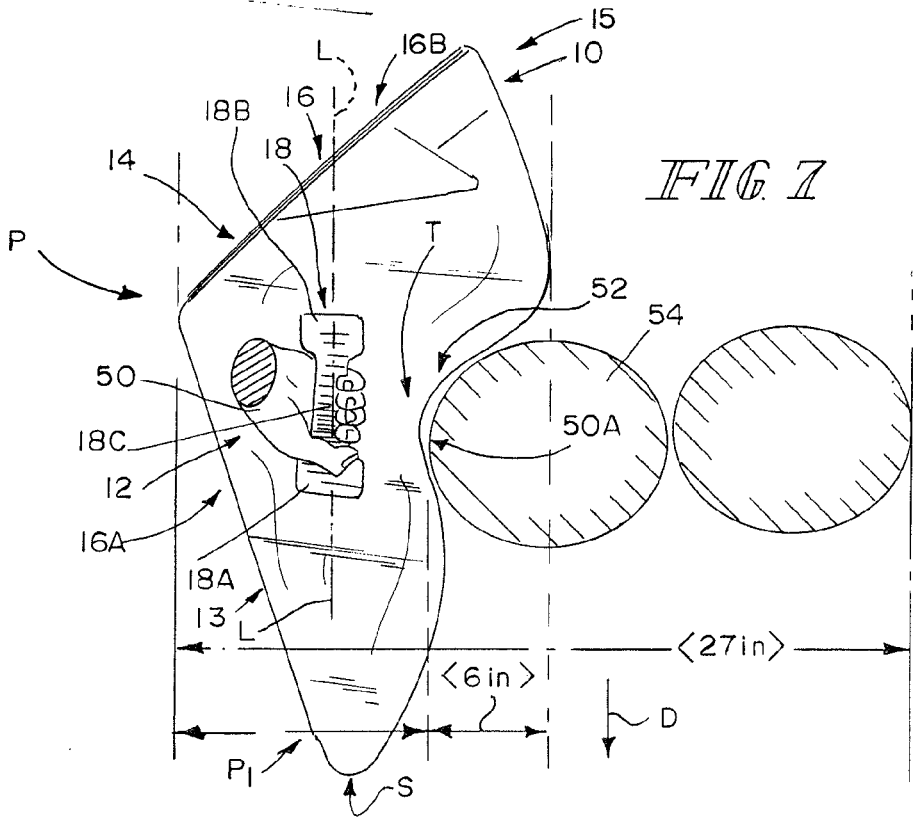
FIG. 7 is an enlarged cross-sectional view taken along line 7-7 of FIG. 6 showing the user's leg nestled in the notched part of the bag and further showing the space-saving configuration created by the handle placement on the side panel.

Bag 10 further includes a carrying handle 18 coupled to, for example, one of two side panels 20 of the bag 10, the coupled handle 18 providing a means for lifting the package P such that when a user 50 picks up the package P, the package P is ergonomically balanced in the user's hand as shown in FIG. 6. In addition, when a user 50 lifts the package P, a portion of the package is cradled about the user's leg 54 located immediately adjacent to the package P, thereby providing a space-saving carrying position to minimize a space S occupied by a portion P of the package extending beyond the user's leg 54, as shown in FIG. 7.

Bag 10 also includes a media card or tag 22 configured to be inserted into a card-receiver pocket 24 provided on a front panel 26 of the bag 10. Front panel 26 includes a plurality of seams 11 that help to shape the front panel 26 such that when the juvenile seat 16 is contained in bag 10, front panel 26 essentially conforms to front portion 16F of seat 16. All or a portion of front panel 26 may be transparent, as, for example, transparent front section 26T. The remainder of front panel 26 may also be transparent.

Media tag 22 includes a first message 28 on a first side 30 of media tag 22 and a second message 32 on a second side 34 of media tag 22. Media tag 22 is configured to be "flipped over" and inserted into card-receiver pocket 24 to reveal either the first or second message 28, 32, as suggested in FIGS. 1-3.

As shown in FIG. 3, seat 16 is contained within bag 10, which bag 10 is shown as being essentially completely transparent but which could have portions or panels that are not transparent (not shown).

As further shown in FIGS. 1 and 3, bag 10 includes a flap 38 that, in an opened position as shown in FIG. 1, extends downwardly from lower chamber 14 and in a closed position, as shown in FIG. 3, is coupled to lower chamber 14 by a zipper mechanism 40 configured to close flap 38 around lower chamber 14 and contain seat 16 in bag 10 in a use position.

As shown in FIG. 4, media tag 22 is resting in card-receiver pocket 24 at a slight inward-facing angle relative to bottom area 42 and tilted toward a bottom portion 16E of seat 16. It is within the scope of the present disclosure that media tag 22 may rest essentially perpendicular to bottom area 42 or at an angle that is more than the slight inward-facing angle shown. As suggested in FIG. 3 and shown in FIG. 4, media tag 22 is inserted in card-receiver pocket 24 formed on an interior surface 26A of transparent front section 26T. As further shown in FIG. 4, bottom portion 16E of seat 16 is situated in lower chamber 14. Zipper mechanism 40, which is configured to close a flap 38 around a bottom area 42 of lower chamber 14 to help contain seat 16 in bag 10, is shown in a partly closed position, as evidenced by zipper tab 40A being located approximately mid-way along bottom area 42. Bottom area 42 of lower chamber 14 is defined to include lower edge 44 that includes a tooth portion 14A of lower chamber 14 designed to mate with a tooth portion 38A on flap 38.

Figure 5:
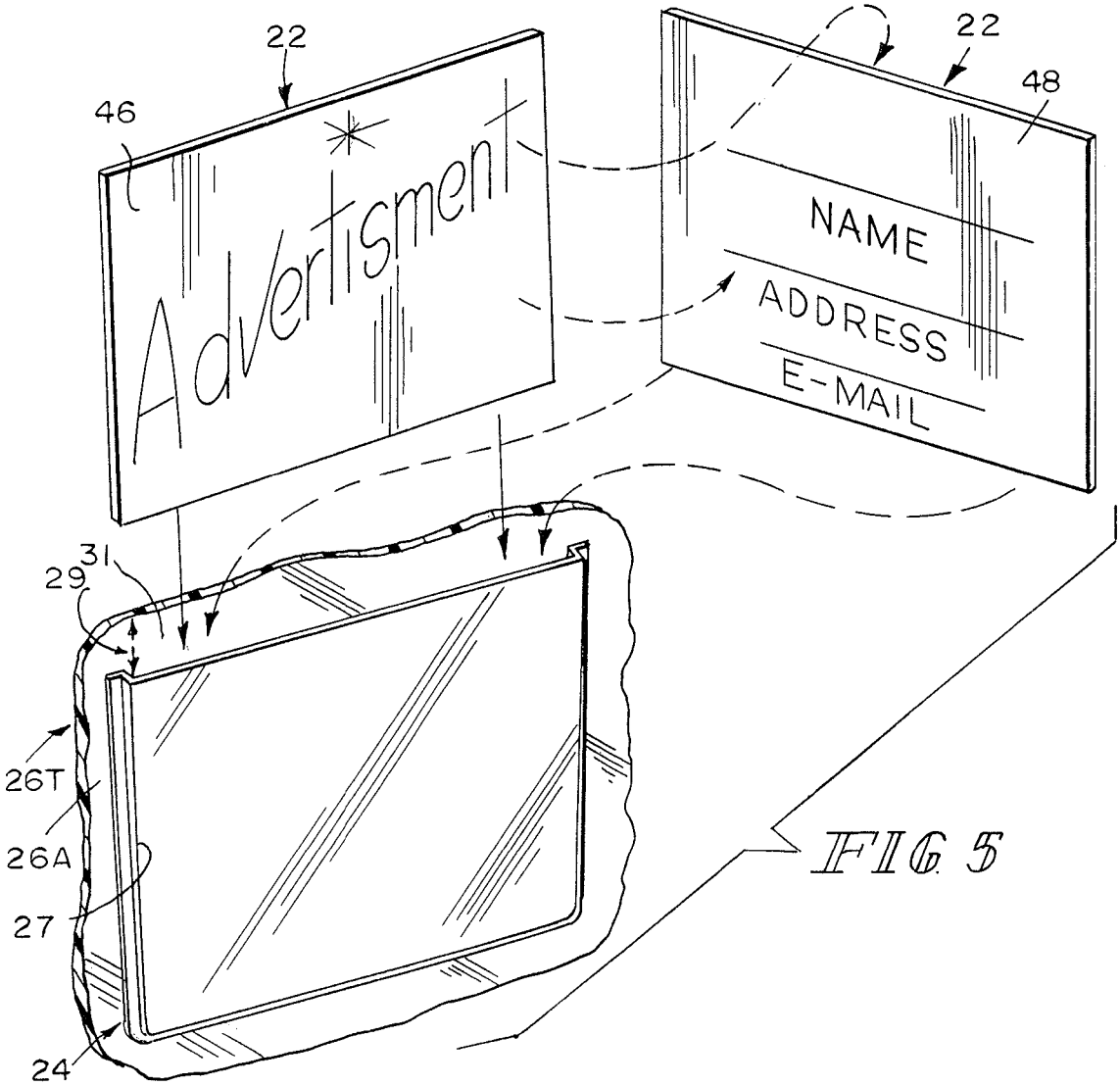
FIG. 5 is an enlarged perspective view of a portion of the transparent front panel of FIG. 1 showing provision of different messages on opposing surfaces of the media tag and further showing the configuration of the media tag to be turned around, as suggested by the broken-line arrows, and inserted into the card-receiver pocket, as suggested by the solid-line arrows.

As shown in FIGS. 4 and 5, card-receiver pocket 24 is defined by interior surface 26A of transparent front section 26T and an interior panel 27 of card-receiver pocket 24. Card-receiver pocket 24 may be formed integrally with transparent front section 26T or interior panel 27 may be coupled to transparent front section 26T to form card-receiver pocket 24. Interior panel 27 is sized such that a sufficient space 29 is provided between an upper portion 10A of bag 10 and an upper portion 27A of interior panel 27 to permit media tag 22 to be inserted into and removed from card-receiver pocket 24. Interior panel 27 is formed or coupled to transparent front section 26T in such a manner that an opening 31 is sufficient to receive and retain media tag 22 in card-receiver pocket 24.

As shown in FIG. 5, different messages may be placed on opposing surfaces 46, 48 of media tag 22. For example, first surface 46 includes an advertisement for seat 16 to be displayed in card-receiver pocket 24 when bag 10 containing seat 16 is on display in a retail store. Second surface 48 includes, for example, the name and address of a purchaser/user of seat 16 when the user is traveling, for instance, by train or plane and the bag 10/seat 16 combination is being checked as luggage or carried on the train or plane. To accommodate these different uses, media tag 22, as shown in FIG. 5, is configured to be turned around, as suggested by the broken-line arrows, and inserted into card-receiver pocket 24, as suggested by the solid-line arrows.

As shown in FIGS. 6 and 7, the means for lifting package P includes carrying handle 18 located on side panel 20 and coupled at a first end 18A to a portion of upper chamber 12 of bag 10 overlying upper side portion 16C and coupled at a second end 18B to a portion of lower chamber 14 overlying lower side portion 16D. Handle 18 further includes a grip or gripping portion 18C interconnecting and located between the first and second ends 18A, 18B. Handle 18 includes a longitudinal axis L bisecting the first end 18A, grip portion 18C and second end 11B. Longitudinal axis L lies a plane substantially parallel to a direction of travel D and lies in a vertical plane intersecting vertical planes of a bottom area 15 of lower chamber 14 and a rear area 13 of upper chamber 12. First end 18A of handle 18 overlies upper chamber 12 and is coupled to a first of the side panels 20 and second end 18B of handle 18 overlies lower chamber 14 and is also coupled to the first of the side panels 20.

Handle 18 is coupled to and located on one of the side panels 20 in such a manner and configuration that a user 50, when lifting the package P, is able to cradle a notched part 52 of package P around the user's leg 54 to provide an ergonomically, balanced, comfortable and space-saving carrying position to minimize a distance or space S that a portion P1 of package P extends beyond a side 50A of user's leg 54 and allowing two ends of the package P to be supported at substantially a same height. Back portion 16A, base portion 16B, upper chamber 12 and lower chamber 14 cooperate to form notched part 52 at an intersection T of back portion 16A and base portion 16B of seat 16, and handle 18 lies essentially adjacent to the notched part 52. For example, as shown in FIG. 7, handle 18 is located such that approximately 6" of space is saved, from an over-all width of approximately 27", enabling user 50 to walk, for example, in travel direction D in which the user is facing, more comfortably and safely, for example, down the aisles of stores and/or the aisles of trains or planes.

Figure 8:
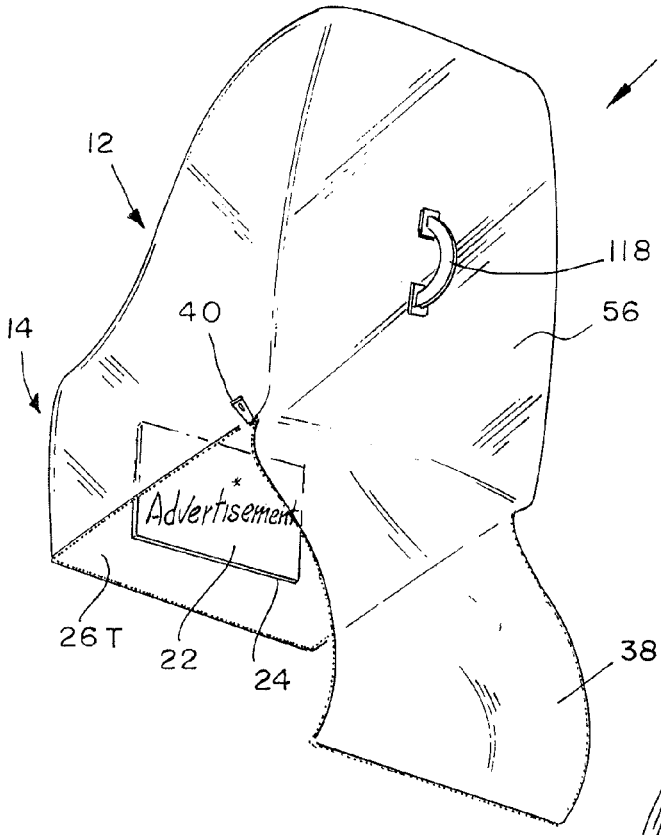
FIG. 8 is a perspective view of another embodiment of a product display and carrying bag, in accordance with the present disclosure, showing the handle located on a rear panel of the bag.

In another embodiment, as shown in FIG. 8, product display and carrying bag 110 includes a handle 118 located on a rear panel 56 of bag 110. Similarly to bag 10, bag 110 is sized to conform to the configuration of a juvenile product and to be placed over and contain the juvenile product, such as seat 16. Bag 110 also includes card-receiver pocket 24, media tag 22 and other features included in to the embodiment of bag 10, as shown in FIGS. 1-7, except for handle 118.

Figure 9:
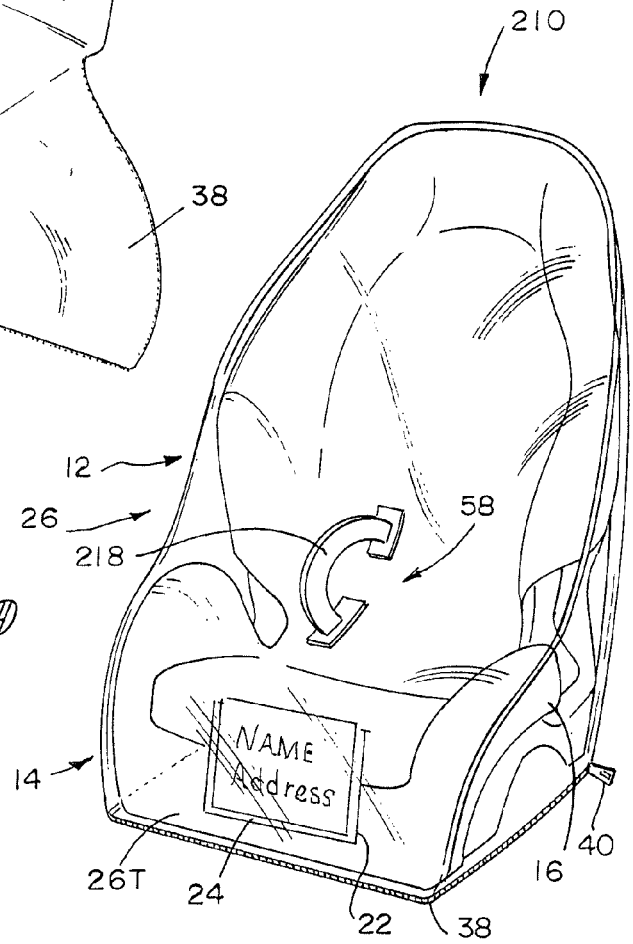
FIG. 9 is a perspective view of yet another embodiment of a product display and carrying bag, in accordance with the present disclosure, showing the handle located on a front panel of the bag.

In yet another embodiment, as shown in FIG. 9, product display and carrying bag 210 conforms to and contains seat 16. Bag 210 includes a handle 218 located on a center portion 58 of front panel 26 of bag 210. Bag 210 also includes card-receiver pocket 24, media tag 22 and other features included in the embodiment of bag 10, as shown in FIGS. 1-7, except for handle 218.

It is within the scope of the present disclosure that handle 18 may be located on the opposite side panel 20 to the side panel 20 shown in FIG. 1 or handle 18 may be located in both side panels 20.

It is within the scope of the present disclosure that card-receiver pocket 24 may be provided at other locations on other transparent panels or on non-transparent panels of bags 10, 110 and 210.

It is within the scope of the present disclosure that juvenile vehicle seat 16 is configured to be stackable or nestable upon an another juvenile vehicle seat 16 whether seat 16 is in a stand-alone status or contained inside bag 10. Such stackablity and nestability is useful to reduce shipping and storage requirements. In addition, the package P formed when juvenile vehicle seat 16 is contained in bags 10, 110, 210 allows for more convenient and less costly shipping from the manufacturer because a plurality of packages P may be nested and shipped in a single cardboard container. Consequently, the storage space required by the retailer is reduced. Shipping costs are reduced because less cardboard boxes are needed, less paper resources are consumed and smaller facilities are needed for storage space. The consumer in turn receives added value because the carrying bags 10, 110, 210 are reusable by the consumer for transport and storage. Moreover, the transparent portions of carrying bags 10, 110, 210 allow consumers to view their purchases before payment.

The invention claimed is:

1. A packaged juvenile vehicle seat comprising:

a juvenile vehicle seat having a contoured configuration including a contoured back portion, a contoured front portion, a contoured base portion and contoured opposing side portions, a carrying bag pre-shaped to the contoured configuration of the juvenile vehicle seat, the carrying bag including a front panel, a bottom panel, and a contoured back panel joined to two opposing contoured side panels, the carrying bag being sized and configured to substantially conform to the contoured back portion and the contoured side portions of the juvenile vehicle seat, the juvenile vehicle seat being inside the carrying bag and together forming a package, and lifting means located on one of the opposing contoured side panels for lifting the package such that when a user picks up the package, the package is ergonomically balanced in the user's hand allowing two ends of the package to be supported at substantially a same height.

2. The packaged juvenile seat of claim 1, wherein the front panel is a contoured front panel sized and configured to substantially conform to the contoured front portion of the juvenile vehicle seat.

3. The packaged seat of claim 2, wherein the front, back, side and bottom panels of the carrying bag form an upper and a lower chamber configured to receive and retain the juvenile vehicle seat inside the carrying bag.

4. The packaged juvenile seat of claim 2, wherein the contoured front portion and contoured opposing side portions of the juvenile seat cooperate to form a concave-shaped receiving space and the contoured front panel of the carrying bag is pre-shaped to substantially conform to the concave-shaped receiving space of the juvenile vehicle seat.

5. The packaged juvenile vehicle seat of claim 3, wherein the lifting means includes a handle having a first end of the handle overlying the upper chamber and coupled to a first of the contoured side panels and having a second end of the handle overlying the lower chamber and coupled to the first of the contoured side panels.

6. The packaged juvenile vehicle seat of claim 5, wherein the handle further includes a gripping portion and a longitudinal axis longitudinally bisecting the first end, the second end, and the gripping portion, and the longitudinal axis lies in a vertical plane intersecting a vertical plane of a bottom area of the lower chamber and a vertical plane of a rear area of the upper chamber.

7. The packaged juvenile vehicle seat of claim 1, wherein the lifting means includes a handle having a first end coupled to a first of the contoured side panels of the carrying bag and arranged to overlie an upper part of a first of the contoured side portions of the juvenile vehicle seat and a second end of the handle coupled to the first of the contoured side panels of the carrying bag and arranged to overlie a lower part of the first of the contoured side portions of the juvenile vehicle seat.

8. The packaged juvenile vehicle seat of claim 5, wherein the contoured side panels are pre-shaped to substantially conform to the contoured side portions of the juvenile vehicle seat.

9. The packaged juvenile vehicle seat of claim 7, wherein the contoured side panels are pre-shaped to substantially conform to the contoured side portions of the juvenile vehicle seat.

10. A packaged juvenile vehicle seat comprising:

a juvenile vehicle seat having a contoured configuration including a contoured back portion, a contoured front portion, a contoured base portion and contoured opposing side portions, a carrying bag including a front panel, a bottom panel, a contoured back panel, and opposing contoured side panels, the juvenile vehicle seat being inside the carrying bag and together forming a package, lifting means located on one of the opposing contoured side panels for lifting the package such that when a user picks up the package, the package is ergonomically balanced in the user's hand allowing two ends of the package to be supported at substantially a same height; and wherein the contoured back panel and the opposing contoured side panels are joined together to form a form-fitting structure that substantially conforms to the contoured back portion and contoured opposing side portions of the juvenile vehicle seat.

11. The packaged juvenile seat of claim 10, wherein the contoured back panel and the contoured opposing side panels include edges that cooperate to form seams therebetween.

12. The packaged seat of claim 10, wherein the front, back, side and bottom panels of the carrying bag are joined together to form a form-fitting structure that substantially conforms to contoured back, front, base and opposing side portions of the juvenile vehicle seat inside the carrying bag.

* * * * *